US006062183A

United States Patent [19]

Sato et al.

[11] Patent Number: 6,062,183

[45] Date of Patent: May 16, 2000

[54] VARIABLE VALVE OPERATION CONTROL APPARATUS

[75] Inventors: Osamu Sato, Takahama; Yoshihito Moriya, Nagoya; Kiyoshi Sugimoto, Okazaki, all of Japan

[73] Assignees: Denso Corporation, Kariya; Toyota Jidosha Kabushiki Kaisha, Toyota, both of Japan

[21] Appl. No.: 09/233,477

[22] Filed: Jan. 20, 1999

[30] Foreign Application Priority Data

Jan. 20, 1998 [JP] Japan ..... 10-008782

[51] Int. Cl.[7] ..... F01L 1/344; F01L 13/00

[52] U.S. Cl. ..... 123/90.17; 123/90.18; 123/90.31; 74/568 R; 464/2

[58] Field of Search ..... 123/90.15, 90.17, 123/90.18, 90.31; 74/568 R; 464/1, 2, 160

[56] References Cited

U.S. PATENT DOCUMENTS

| | | | |
|---|---|---|---|
| 4,517,936 | 5/1985 | Burgio di Aragona | 123/90.5 |
| 4,693,214 | 9/1987 | Titolo | 123/90.18 |
| 5,080,055 | 1/1992 | Komatsu et al. | 123/90.17 |
| 5,381,764 | 1/1995 | Fukuma et al. | 123/90.17 |
| 5,765,518 | 6/1998 | Nakano | 123/90.17 |
| 5,893,345 | 4/1999 | Sugimoto et al. | 123/90.17 |
| 5,924,397 | 7/1999 | Moriya et al. | 123/90.18 |

FOREIGN PATENT DOCUMENTS

| | | |
|---|---|---|
| 7-301106 | 11/1995 | Japan . |
| 9-32519 | 2/1997 | Japan . |
| 9-151710 | 6/1997 | Japan . |

OTHER PUBLICATIONS

A. Titolo, "The Variable Valve Timing System—Application on a V8 Engine", SAE 910009, 1991, pp. 8–15.

*Primary Examiner*—Weilun Lo
*Attorney, Agent, or Firm*—Nixon & Vanderhye P.C.

[57] ABSTRACT

In a variable valve operation control apparatus, an exhaust camshaft and an intake camshaft are held non-movably and movably in the axial direction, respectively. The intake camshaft has a profile varying in the axial direction. A timing pulley and the exhaust camshaft are fixed by a bolt to drive the exhaust camshaft by a crankshaft. A vane rotor is fixed to the exhaust camshaft, while a shoe housing and a gear are held rotatably relative to the vane rotor. Torque gears are provided on the intake camshaft to rotate with the intake camshaft. The rotational phase of the intake camshaft relative to the crankshaft is adjusted by hydraulically varying the rotational phase of the shoe housing relative to the vane rotor.

5 Claims, 4 Drawing Sheets

VARIABLE VALVE OPERATION CONTROL APPARATUS

CROSS REFERENCE TO RELATED APPLICATION

This application relates to and incorporates herein by reference Japanese Patent Application No. 10-8782 filed on Jan. 20, 1998.

BACKGROUND OF THE INVENTION

1. Field of the Invention

The present invention relates to a variable valve operation control apparatus, which controls variably valve opening/closing timing, valve opening period and/or valve lift of an intake valve and/or exhaust valve of an engine in accordance with engine operating conditions.

2. Related Art

It is known, as disclosed in JP-A-9-32519, to control variably a valve opening period and valve lift of an intake valve and/or exhaust valve of an engine by driving in an axial direction a camshaft having a cam profile, which varies in the axial direction.

It is also known, as disclosed in JP-A-9-151719, to control variably a phase of a second camshaft relative to a first camshaft in accordance with engine operating conditions, in a system where a driving force is transmitted from the first camshaft to the second camshaft. That is, a rotational phase of the second camshaft relative to the first camshaft is variably adjusted, so that the second camshaft adjusts an opening/closing timing of a valve associated with the second camshaft.

It is possible to combine the above two controls. That is, an axial driving mechanism for varying the valve opening period and the valve lift by driving the camshaft having the varying cam profile in the axial direction may be combined with a phase adjusting mechanism for adjusting the rotational phase of the second camshaft relative to the camshaft.

In this combined system, the phase adjusting mechanism is supported by the camshaft when the camshaft does not move in the axial direction, because the phase adjusting mechanism is normally supported by a member which does not move in the axial direction. The phase adjusting mechanism has a camshaft-side rotary body, which rotates with the camshaft. Therefore, in the case that the phase adjusting mechanism is assemble to the camshaft which does not move in the axial direction, it can be supported by simply fixing the camshaft-side rotary body to the camshaft by bolts or the like.

It is however required to support the phase adjusting mechanism rotatably not by the first camshaft but by a cylinder head of the engine, for instance, in the case that the phase adjusting mechanism is assembled to the first camshaft. Because the cylinder head is not rotatable, a rotatable member is required additionally to support the phase adjusting mechanism rotatably relative to the cylinder head, resulting in an increase in the number of component parts.

As the first camshaft is movable in the axial direction, a fluid passage formed in the first camshaft and a fluid passage formed in the phase adjusting mechanism must be held in communication with each other through a communication passage. Thus, for instance, the communication passage must be formed longitudinally, resulting in a complicated machining for the communication passage.

Further, gear teeth hitting sound is generated at a spline-engagement part which enables the axial movement of the camshaft and/or a gear-meshing part which transmits the driving force from the first camshaft to the second camshaft, because the second camshaft is subjected to positive and negative changes in torque applied thereto.

SUMMARY OF THE INVENTION

It is therefore an object of the present invention to provide a variable valve operation control apparatus having a plurality of driven shafts, which is simple in construction and can be produced simply.

It is another object of the present invention to provide a variable valve operation control apparatus, which reduces gear teeth hitting sound caused by positive and negative changes in the torque applied to a driven shaft movable in an axial direction.

According to the present invention, a first driven shaft is held non-movably in an axial direction and a second driven shaft is held movably in the axial direction. A phase adjusting mechanism is supported on the first driven shaft for adjusting a rotational phase of the second driven shaft relative to the first driven shaft. The phase adjusting mechanism includes a first rotary body rotatable with the first driven shaft, and a driving-side rotary body rotatable relative to the first rotary rotary body. A second rotary body is driven by the driving-side rotary body to rotate the second driven shaft.

Thus, the phase adjusting mechanism can be supported by the first driven shaft such as an exhaust camshaft in place of other members such as an engine cylinder head. Further, as the first driven shaft is non-movable in the axial direction, the first rotary body can be coupled with the first driven shaft without a spline-engagement, for instance. As a result, a supporting structure for the phase adjusting mechanism, and assembling of the phase adjusting mechanism to the second driven shaft are simplified.

Preferably, the second rotary body driven by the phase adjusting mechanism includes a plurality of gears and a biasing member. The biasing member biases the gears in opposite directions so that inner and outer teeth of the gears are displaced in a circumferential direction. As there exists no backlash in gear engagement part and spline engagement part, teeth hitting sound occurring in the engagement parts can be suppressed even when the second driven shaft is subjected to positive and negative torque changes.

Preferably, an axial driving mechanism is disposed adjacently to the second driven shaft to move the second driven shaft in the axial direction. Thus, the phase adjusting mechanism and the axial driving mechanism can be assembled compactly.

BRIEF DESCRIPTION OF THE DRAWINGS

Other objects, features and advantages of the present invention will become more apparent from the following detailed description made with reference to the accompanying drawings, throughout which the same reference numerals are used to designate the same or like component parts. In the drawings.

DETAILED DESCRIPTION OF THE PREFERRED EMBODIMENT (First Embodiment)

Figure 1:
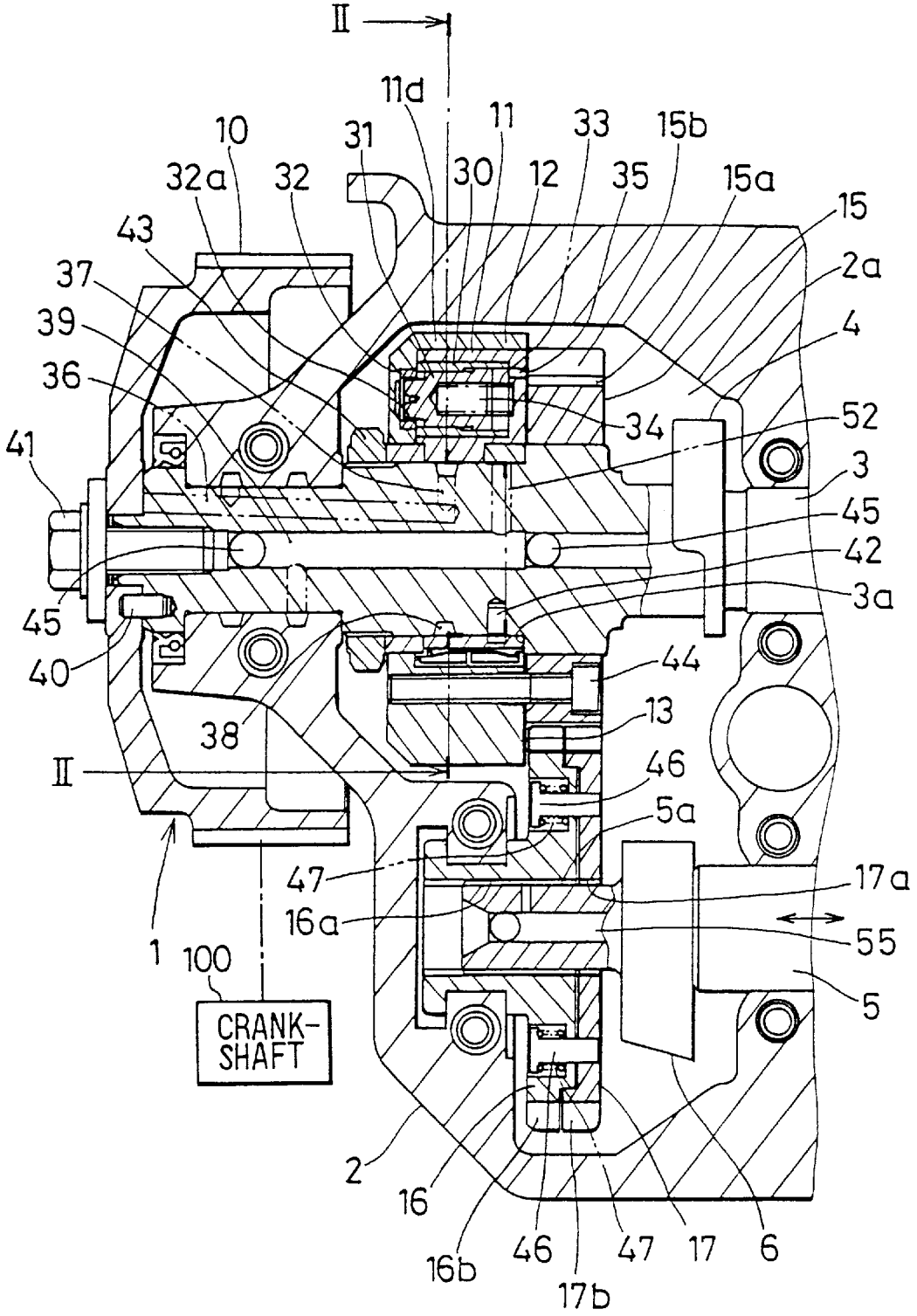
FIG. 1 is a sectional view showing a variable valve operation control apparatus according to a first embodiment of the present invention.
Figure 2:
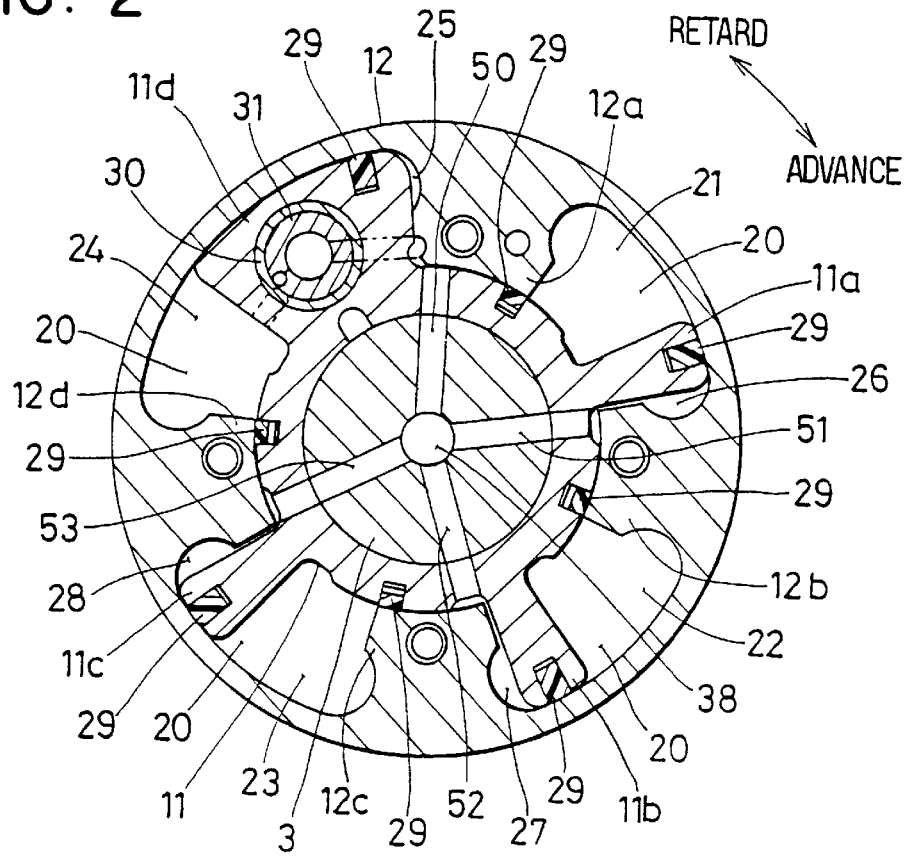
FIG. 2 is a sectional view of the first embodiment taken along a line II—II in FIG. 1.

Referring first to FIGS. 1 and 2, a variable valve operation control apparatus 1 for an engine is a hydraulically controlled type, which transmits the driving force of an engine crankshaft (driving shaft) 100 to an exhaust camshaft (first driven shaft) 3 for engine exhaust valves (not shown) and to an intake camshaft (second driven shaft) 5 for engine intake valves (not shown). Both shafts 3, 5 are supported rotatably in an engine cylinder head 2. The exhaust camshaft 3 is not movable in the axial direction, and has a cam 4 which opens and closes a corresponding exhaust valve. The cam 4 has the same profile on its outer peripheral circumference in the axial direction. The intake camshaft 5 is held movably in the axial direction, so that it may be driven in the axial direction by an axial driving mechanism (not shown). The intake camshaft 5 has a cam 6, which opens and closes a corresponding intake valve. The cam 6 has on its outer peripheral circumference a profile, which varies in the axial direction. The left-side profile is used when the engine runs at low speeds, and the right-side profile is used when the engine runs at higher speeds.

A timing pulley 10 is fixed to the exhaust camshaft 3 by a bolt 41. The position of the timing pulley 10 relative to the exhaust camshaft 3 in a rotational direction is regulated by a pin 40. Thus, the driving force of the crankshaft 100 is transmitted to the exhaust camshaft 3 through the timing pulley 100. A generally cylindrical vane rotor (first rotary body) 11 is pressed onto a step 3*a* of the exhaust camshaft 3 by a nut 43, so that it is fixedly fitted on the exhaust camshaft 3. The position of the vane rotor 11 relative to the exhaust camshaft 3 by a pin 42 in its rotational direction and in its axial direction. Thus, the timing pulley 10, the exhaust camshaft 3 and the vane rotor 11 rotate with the crankshaft 100 in a clockwise direction (FIG. 2), when viewed from the left side in FIG. 1.

A shoe housing 12 and a gear (first toothed wheel) 15 are fixedly coupled to each other by bolts 44 to operate as a driving-side rotary body. The shoe housing 12 is assembled around the vane rotor 11 rotatably, so that the rotational phase of the shoe housing 12 relative to the vane rotor 11 is varied hydraulically. The shoe housing 12 and the gear 15 are rotatable relative to the timing pulley 10, exhaust camshaft 13 and vane rotor 11. The vane rotor 11 and the shoe housing 12 thus operate as a phase adjusting mechanism, which is supported on the exhaust camshaft 3.

A positive torque gear 16 and a negative torque gear 17 are provided as a second gear. The second wheel and the second rotary body have the same construction. The gears 16, 17 are arranged so that gear teeth 16*b*, 17*b* formed around the outer peripheral circumferences are in meshing engagement with gear teeth 15*b* of the gear 15, and so that splines 16*a*, 17*a* formed on the inner peripheral circumference are spline-engaged on a spline 5*a* formed on the intake camshaft 5. As shown in FIG. 3, the gear teeth 15*b*, 16*b*, 17*b* are inclined, while the splines 15*a*, 16*a*, 17*a* are straight. Thus, the intake camshaft 5 is fitted in the positive torque gear 16 and the negative torque gear 17 reciprocally movably therein. The positive torque gear 16 is fixed to the cylinder head 2.

Figure 3A:
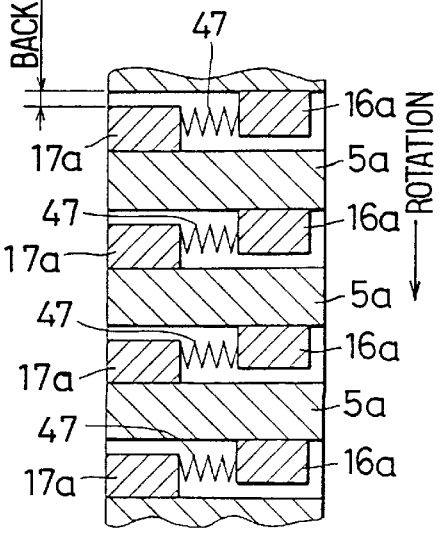
FIGS. 3A and 3B are schematic sectional view showing a spline-engagement part and a gear meshing part of the first embodiment.
Figure 3B:
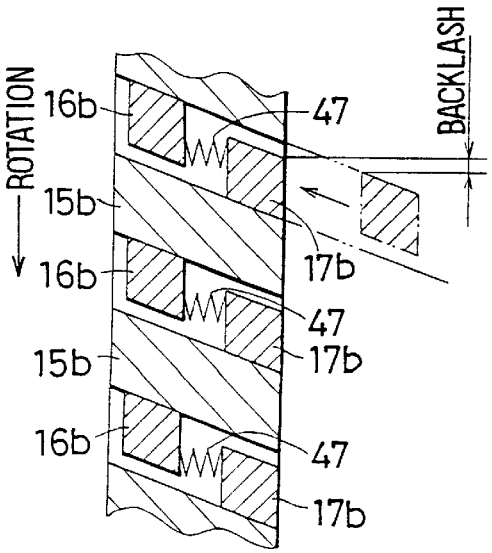

A pin 46 is fitted into the negative torque gear 17. A spring 47 is disposed to bias the pin 46 normally toward left in FIG. 1, so that the gears 16, 17 are biased in opposite directions, that is, in facing directions. Thus, the torque gears 16, 17 are thus biased to approach each other. As shown in FIGS. 3A and 3B, the splines 16*a*, 17*a* are displaced and the gear teeth 16*b* 17*b* are displaced in the rotation direction, under the condition that the torque gears 16, 17 are engaged with the gear 15 and the intake camshaft 5. The spline 16*a* and the gear teeth 16*b* of the positive torque gear 16 abut the spline 5*a* and the gear teeth 15*b*, respectively, at the trailing side of the rotational direction. The spline 17*a* and the gear teeth 17*b* of the negative torque gear 17 abut the spline 5*a* and the gear teeth 15*b*, respectively, at the leading side of the rotational direction.

When the cam 6 drives the intake valve to open and close, the intake camshaft 5 receives a positive torque and a negative torque. As the average of those torque is positive, the torque exerted on the positive torque gear 16 is larger than that exerted on the negative torque gear 17. Thus, the biasing force of the spring 47 can be reduced by this arrangement, in which the cylinder head 2 supports the positive torque gear 16 non-movably in the axial direction and the spring 47 biases the negative torque gear 17 toward the positive torque gear 16.

The shoe housing 12 and a rear plate 13 cover axial sides of the vane rotor 11. As shown in FIG. 2, the vane rotor 11 has vanes 11*a* to 11*d* arranged substantially equi-angularly in the circumferential direction and extending in radially outward direction. The shoe housing 12 has shoes 12*a* to 12*d* extending in a radially inward direction and arranged substantially equi-angularly in the circumferential direction. Thus, the adjacent two of the shoes 12*a* to 12*d* define a fan-shaped fluid chamber 20 therebetween. The vanes 12*a* to 12*d* are disposed in the fluid chambers 20 relatively movably, respectively. The clockwise and counter-clockwise directions in FIG. 2 indicate rotational directions of the shoe housing 12 relative to the vane rotor 11 for advancing and retarding valve operation (opening and closing) timing. The shoe housing 12 is shown as positioned at the most retarded position relative to the vane rotor 11. The most retarded position of the shoe 12 is regulated by the engagement of the retard-side (left side) surface of the shoe 12*a* with the advance-side (right side) surface of the vane 11*d*.

Each of the vanes 11*a* to 11*d* divides the fluid chamber 20 into a retard side chamber and an advance side chamber. That is, retard side chambers 21, 22, 23, 24 are provided between the vane 11*a* and the shoe 12*a*, between the vane 11*b* and the shoe 12*b*, between the vane 11*c* and the shoe 12*c*, and between the vane lid and the shoe 12*d*, respectively. Advance side chambers 25, 26, 27, 28 are provided between the vane 11*d* and the shoe 12*a*, between the vane 11*a* and the shoe 12*b*, between the vane 11*b* and the shoe 12*c*, and between the vane 11*c* and the shoe 12*d*, respectively.

A seal 29 is fitted on each radially outer peripheral surface of the vanes 11*a* to 11*d*, and is biased toward each radially inner peripheral surface of the shoe housing 12 by a leaf spring. Thus, the seal 29 is held in sliding contact with each inner peripheral surface of the shoe housing 12. The seal 29 restricts leakage of fluid between vane-divided chambers in each fluid chamber 20, because a clearance is provided between each outer peripheral surface of the vanes 11*a* to 11*d* and each inner peripheral surface of the shoe housing 12.

A guide ring 30 is press-fitted into the vane 11*d* in the axial direction, and a stopper piston 31 is inserted into the guide ring 30 slidably in the axial direction. The stopper piston 31 has a cylindrical shape with a bottom. The stopper piston 31 is biased toward a stopper hole 32*a* by a spring 33. A fitting ring 32 is fitted into a fitting hole formed in the shoe housing 12. The fitting ring 32 has a stopper hole 32*a* at its radially inner wall. The stopper piston 31 is fitted into the stopper hole 32*a* at the most retarded position of the shoe housing 12. The shoe housing 12 is restricted from rotating relatively to the vane rotor 11 under the condition that the stopper piston 31 is fitted into the stopper hole 32*a* to abut the stopper hole in the rotational direction. That is, the stopper piston 31 and the stopper hole 32*a* are in the restricted condition at the most retarded rotational position of the shoe housing 12.

The stopper piston 31 is arranged to receive fluid pressure from both advancing side and retarding side at its pressure receiving surface. The pressure applied from the fluid to the stopper piston 31 exerts to push out the stopper piston 31 from the stopper hole 32*a*. The stopper piston 31 is pushed out from the stopper hole 32*a* against the spring 33, when the fluid pressure exceeds a predetermined level. The stopper piston 31 and the stopper hole 32*a* are positioned, so that the stopper piston 31 is capable of being fitted into the stopper hole when the shoe housing 12 is at the most retarded position relative to the vane rotor 11, that is, when the intake camshaft 5 is at the most retarded position relative to the crankshaft 100.

The cylinder head 2 has a lubricating oil chamber 2*a* therein. This chamber 2*a* is in communication with an air vent 35 formed in the rear plate side of the vane 11*d*, an air vent (not shown) formed in the rear plate 13, and an air vent 15*a* formed in the gear 15. Those air vents communicate with a back pressure chamber 34 of the stopper piston 31 at the most retarded position. The stopper piston 31 is enabled to move at the most retarded position, as the back pressure chamber 34 is vented to the outside atmosphere. The communication between the back pressure chamber 34 and the air vents are interrupted, when the shoe housing 12 rotates from the most retarded position toward the advanced position, that is, when the shoe housing 12 rotates to a non-restricted position where the stopper piston 31 and the stopper hole 32*a* is disabled to fit.

Fluid passages 36, 39 are formed in the exhaust camshaft 3 in the axial direction. The fluid passages 36, 39 are connectable to either a hydraulic pump as a driving source (not shown) or to a drain (not shown). The fluid passage 36 is in communication with the retard side chambers 21, 22, 23, 24 through an annular passage 38. The fluid passage 39 is in communication with the advance side chamber 25, 26, 27, 28 through fluid passages 50, 51, 52, 53. Both ends of the fluid passage 39 are closed by balls 45. The intake camshaft 5 is formed with a passage 55 to supply lubrication oil to the spline-engagement part between the intake camshaft 5 and the torque gears 16, 17.

The fluid pressure in the retard side chambers 21, 22, 23, 24 and the fluid pressure in the advance side chambers 25, 26, 27, 28 are controlled in the known manner, so that the rotational phase of the shoe housing 12 relative to the vane rotor 11 is varied, that is, the rotational phase of the intake camshaft 5 relative to the crankshaft 100 is variably adjusted.

The above first embodiment operates as follows.

At engine cranking time in which the fluid is not yet supplied from the hydraulic pump into the fluid chambers 20, the shoe housing 12 is held at the most retarded position relative to the vane rotor 11 as shown in FIGS. 1 and 2. The stopper piston 31 is fitted into the stopper hole 32*a* by the spring 33, thereby holding the vane rotor 11 and the shoe housing 12 rigidly. The intake camshaft 5 is subjected to positive and negative changes in the torque applied when the intake valves are opened and closed. Even if the torque changes are transmitted to the shoe housing 12, the shoe housing 12 does not generate rotational vibration in the advancing and retarding directions relative to the vane rotor 11. Thus, hitting sound caused by collision between the vane rotor 11 and the shoe housing 12 is suppressed.

More specifically, when the intake camshaft 5 is subjected to the positive torque change, the spline 16*a* of the positive torque gear 16 abut the spline 5*a* of the intake camshaft 5 at the side which is opposite to the rotational direction, and the gear teeth 16*b* abut the gear teeth 15*b* at the side which is opposite to the rotational direction. Thus, the positive torque is received. When the intake camshaft 5 is subjected to the negative torque change, the spline 17*a* of the negative torque gear 17 abut the spline 5*a* of the intake camshaft 5 at the side which is the same as the rotational direction, and the gear teeth 17*b* abut the gear teeth 15*b* at the side which is the same as the rotational direction. Thus, the negative torque is received. As a result, even if the positive and negative torque change is applied to the intake camshaft 5, the teeth hitting sound at the gear-meshing part between the gear 15 and the torque gears 16, 17 and at the spline-engagement part between the intake camshaft 5 and the gears 16, 17. Thus, the shoe housing 12 is restricted from vibrating in the advancing and retarding directions relative to the vane rotor 11.

After engine cranking, the fluid is supplied from the hydraulic pump into the fluid chamber 20. As the fluid pressure is applied also to the stopper piston 31 through the retard side chamber 25, the stopper piston 31 is pushed out from the stopper hole 32*a* against the spring 33. Thus, the shoe housing 12 is enabled to rotate relatively to the vane rotor 11. However, the shoe housing 12 is held at the most retarded position, because the shoe housing 12 receives the fluid pressure of the retard side chambers 21, 22, 23, 24 in the retarding direction. Therefore, even if the positive and negative torque changes are applied to the intake camshaft 5 when driving the intake valves, the hitting sound caused by collision between the vane rotor 11 and the shoe housing 12 is suppressed in the same manner as above.

When the shoe housing 12 is to be rotated relatively to the vane rotor 12 in the advance direction from the most retarded position for opening and closing the valves at the advanced rotational angle of the crankshaft 100, the retard side chambers 21, 22, 23, 24 are vented to the outside atmosphere, and the advance side chambers 25, 26, 27, 28 are supplied with the pressure fluid, by switching over a valve (not shown) by an electronic control unit (not shown). As the fluid pressure is applied from the advance side chamber 25 to the stopper piston 31 at this time, the stopper piston 31 is held pushed out from the stopper hole 32*a*. When the fluid pressure in each advance side chamber 25, 26, 27, 28 rises above the predetermined level, the shoe housing 12 is rotated in the advance side. As the positions of the stopper piston 31 and the stopper hole 32*a* are displaced in the circumferential direction, the stopper piston 31 is disabled to fit into the stopper hole 32*a*.

Thereafter, the rotational phase of the shoe housing 12 relative to the vane rotor 11 is variably adjusted by controlling the fluid pressure in both the retard side chambers 21, 22, 23, 24 and the advance side chambers 25, 26, 27, 28 in accordance with the engine operating conditions. Thus, the rotational phase of the intake camshaft 5 relative to the crankshaft 100 and the exhaust camshaft 3 is varied, so that the opening and closing timing of the intake valves may be adjusted. In addition, the axial driving mechanism controlled by the electronic control unit also drives the intake camshaft 5 in the axial direction in accordance with the engine operating conditions. As a result, the profile of the cam 6 which drives the intake valve is varied so that the opening and closing timing, opening period and lift of the intake valves are adjusted.

(Second Embodiment)

Figure 4:
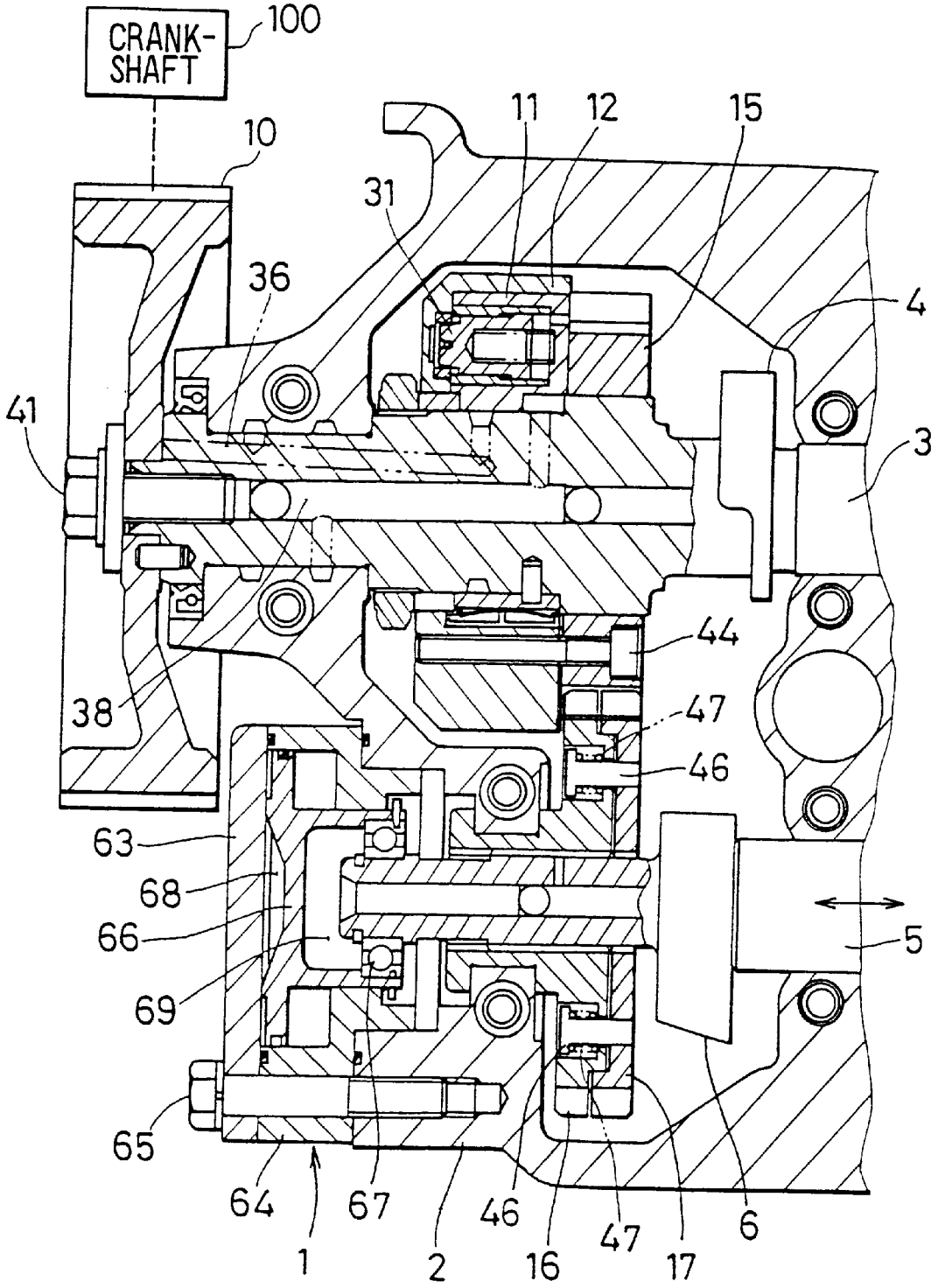
FIG. 4 is a sectional view showing a variable valve operation control apparatus according to a second embodiment of the present invention.

In this embodiment, as shown in FIG. 4, the exhaust camshaft 3 is fixed to the timing pulley 10, which is driven by the crankshaft 100 as in the first embodiment. A cover 63 and a cylindrical member 64 are fixed to the axial side surface of the cylinder head 2 to define a fluid chamber. This chamber is divided into two, a low speed chamber 68 and a high speed chamber 69, by a piston member 66. The cover 63, cylindrical member 64 and the piston member 66 are assembled to the outside of the cylinder head 2. The piston member 66 is attached to the intake camshaft 5 through a bearing 67, so that the intake camshaft 5 is rotatable relative to the piston member 66. Thus, the cover 63, cylindrical member 64 and the piston member 66 operate as the axial driving mechanism, which drives the intake camshaft 5 in the axial direction.

In this embodiment, when the fluid is supplied into the low speed chamber 68 and the fluid in the high speed chamber 69 is discharged into the drain, the intake camshaft 5 moves in the right direction in FIG. 4 together with the piston member 66 so that the low speed side profile of the cam 6 is selected to drive the intake valve. When the fluid in the low speed chamber 68 is discharged into the drain and the fluid is supplied into the high speed chamber 69, on the other hand, the intake camshaft 5 moves in the left direction in FIG. 4 together with the piston member 66 so that the high speed side profile of the cam 6 is selected to drive the intake valve. The cam 6 receives a thrust in the right direction in FIG. 4, when the cam 6 drives the intake valve under the condition that no fluid is supplied into the chambers 68, 69. Thus, the intake camshaft 5 moves in the right direction in FIG. 4, so that the cam 6 drives the intake valve by the low speed side profile at the time of engine cranking.

As the cover 63, cylindrical member 64 and the piston member 66, which constitute the axial driving mechanism, are provided at the side of the torque gears 16, 17 of the intake camshaft 5, that is, at one axial end side of the camshaft 5. The axial driving mechanism may be assembled to the phase adjusting mechanism, which is comprised of the vane rotor 11 and the shoe housing 12, more easily than in the case where the axial driving mechanism is provided at the other axial end side of the camshaft 5 opposite to the gears 16, 17. The variable valve operation control apparatus 1 can be sized compactly.

It is only required that the piston member 66 has two fluid pressure receiving surfaces to receive the fluid pressures in opposite directions and is attached to the intake camshaft 5 to allow rotation of the camshaft 5. Therefore, the pressure receiving surfaces of the piston member 66 may be formed eccentrically from the intake camshaft 5, so that the axial driving mechanism may not interfere with a part of the cylinder head 2 existing near the exhaust camshaft 3. Thus, the axial driving mechanism is enabled to be positioned with less positional constraints.

(Third Embodiment)

Figure 5:
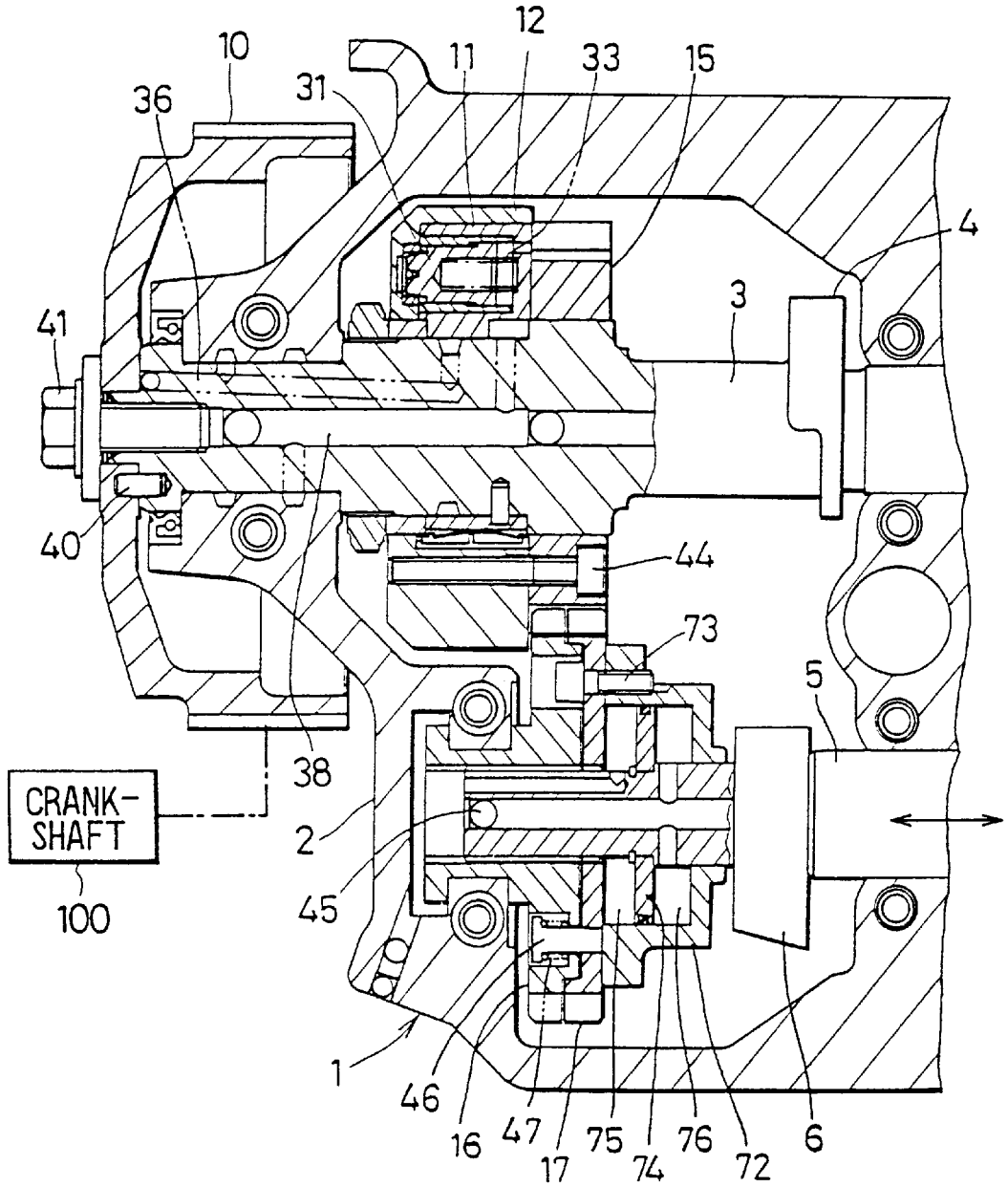
FIG. 5 is a sectional view showing a variable valve operation control apparatus according to a third embodiment of the present invention.

In the third embodiment, as shown in FIG. 5, a cover 72 is fixed to the negative torque gear 17 by bolts 73, so that a cylindrical member 72 is accommodated within the cylinder head 2. A piston member 74 is rotatable with the intake camshaft 5 and movable in the axial direction as guided by the cover 72. The cover 72 and the negative torque gear 17 define a fluid chamber, which is divided into a low speed chamber 75 and a high speed chamber 76 by the piston member 74. The cover 72 and the piston member 74 operate as an axial driving mechanism.

In this embodiment, when the fluid is supplied into the low speed chamber 75 and the fluid in the high speed chamber 76 is discharged into the drain, the intake camshaft 5 moves in the right direction in FIG. 5 together with the piston member 74 so that the low speed side profile of the cam 6 is selected to drive the intake valve. When the fluid in the low speed chamber 75 is discharged into the drain and the fluid is supplied into the high speed chamber 76, on the other hand, the intake camshaft 5 moves in the left direction in FIG. 5 together with the piston member 74 so that the high speed side profile of the cam 6 is selected to drive the intake valve.

As the cover 72 and the piston member 74, which constitute the axial driving mechanism, are provided closely to the side of the torque gears 16, 17 of the intake camshaft 5, that is, at one axial end side of the camshaft 5. The axial driving mechanism may be assembled to the phase adjusting mechanism, which is comprised of the vane rotor 11 and the shoe housing 12, more easily than in the case where the axial driving mechanism is provided at the other axial end side of the camshaft 5 opposite to the gears 16, 17. The variable valve operation control apparatus 1 can be sized compactly.

It is to be understood in the foregoing embodiments that the phase adjusting mechanism (vane rotor 11 and shoe housing 12) can be supported on the exhaust camshaft 3 by a simple work of fastening the nut 43, because the exhaust camshaft 3 does not move in the axial direction. Therefore, the phase adjusting mechanism need not have splines and the like which would otherwise be required when the phase adjusting mechanism is to be assembled to the intake camshaft 5 which is movable in the axial direction. Thus, the construction of the phase driving mechanism can be simplified.

Further, as the passage formed in the exhaust camshaft 3 and the passage formed in the vane rotor 11 do not displace at the communication part in the axial direction, the passages can be formed without difficulty.

The positive torque gear 16 and the negative torque gear 17, which rotate with the intake camshaft 5 to operate as the second gear, are biased in the direction to approach each other by the spring 47. The gear teeth 16*b*, 17*b* formed on the outer peripheral sides of the torque gears 16, 17 and the splines 16*a*, 17*a* formed on the inner peripheral sides of the torque gears 16, 17 are not aligned on line, and are coupled with the gear teeth 15*b* of the gear 15 and the spline 5*a* of the intake camshaft 5. As a result, hitting sound between the teeth can be suppressed even if the intake camshaft 5 is subjected to the positive and negative torque changes.

In the above embodiments, the timing pulley 10 may be replaced by a chain sprocket, a timing gear or the like to receive the rotating force of the crankshaft 100. The driving force of the exhaust camshaft 3 may be transmitted to the intake camshaft 5 by a belt or the like in place of the gear meshing. The gear teeth 15*b*, 16*b*, 17*b* may be provided straight in the axial direction, while the gear teeth 16*a*, 17*a* and the spline 5*a* may be inclined. Further, all the gear teeth and the spline 5*a* may be inclined in the axial direction.

The present invention may be implemented in a further modified manner without departing from the spirit of the invention.

We claim:

1. A variable valve operation control apparatus for controlling valve operation by a driving force of a driving shaft, the control apparatus comprising:

a first driven shaft rotatable with the driving shaft and non-movable in an axial direction;

a second driven shaft movable in the axial direction and having a profile varying in the axial direction;

a phase adjusting mechanism supported on the first driven shaft for adjusting a rotational phase of the second driven shaft relative to the first driven shaft, the phase adjusting mechanism including a first rotary body rotatable with the first driven shaft and a driving-side rotary body coupled with the first rotary body, a rotational phase of the driving-side rotary body relative to the first rotary body being adjustable by fluid pressure; and a second rotary body driven by the driving-side rotary body to rotate the second driven shaft.

2. A control apparatus of claim 1, wherein:

the driving-side rotary body includes a first gear;

the second rotary body includes a second gear having a plurality of toothed wheels, the second gear being gear-engaged with the first gear at an outer peripheral circumference thereof and being spline-engaged with the second driven shaft at an inner peripheral circumference thereof so that the second driven shaft is fitted movably in the axial direction, at least one of engagements between the first gear and the second gear and between the second gear and the second driven shaft being in an inclined teeth fitting; and a biasing member is provided to bias the toothed wheels in opposite directions so that inner and outer teeth of the toothed wheels are displaced in a circumferential direction.

3. A control apparatus of claim 1, further comprising:

an axial driving mechanism is disposed adjacently to the second driven shaft to move the second driven shaft in the axial direction.

4. A control apparatus of claim 3, wherein:

the axial driving mechanism is disposed at an axial end side of the second driven shaft at an opposite side from the cam in the axial direction with respect to the second rotary body.

5. A control apparatus of claim 3, wherein:

the axial driving mechanism is disposed at an axial end side of the second driven shaft at the same side as the cam in the axial direction with respect to the second rotary body.

* * * * *